US011493058B2

(12) United States Patent
Kojovic et al.

(10) Patent No.: US 11,493,058 B2
(45) Date of Patent: Nov. 8, 2022

(54) DIFFUSER PIPE WITH STIFFENING RIB

(71) Applicant: PRATT & WHITNEY CANADA CORP., Longueuil (CA)

(72) Inventors: Aleksandar Kojovic, Oakville (CA); Gavin Kisun, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 220 days.

(21) Appl. No.: 16/530,243

(22) Filed: Aug. 2, 2019

(65) Prior Publication Data

US 2021/0033109 A1 Feb. 4, 2021

(51) Int. Cl.
*F04D 29/54* (2006.01)
*F04D 29/60* (2006.01)

(52) U.S. Cl.
CPC ..... *F04D 29/545* (2013.01); *F04D 29/601* (2013.01)

(58) Field of Classification Search
CPC ..... F01D 9/023; F01D 9/026; F01D 9/045; F01D 9/048; F04D 29/44; F04D 29/444; F23R 3/04; F02C 3/05; F02C 3/08
USPC ..... 60/751
See application file for complete search history.

(56) References Cited

U.S. PATENT DOCUMENTS

| | | | | |
|---|---|---|---|---|
| 8,807,928 | B2 * | 8/2014 | Kareff | F01D 5/143 415/173.6 |
| 9,874,223 | B2 * | 1/2018 | Theratil | F04D 29/441 |
| 9,926,942 | B2 * | 3/2018 | Duong | F02C 3/08 |
| 10,465,708 | B2 * | 11/2019 | Clemen | F04D 29/322 |
| 2014/0369814 | A1 | 12/2014 | Theratil et al. | |
| 2017/0114797 | A1 | 4/2017 | Duong | |

OTHER PUBLICATIONS

European Search Report dated Nov. 9, 2020 for Application No. 20188606.6.

* cited by examiner

*Primary Examiner* — Todd E Manahan
*Assistant Examiner* — David P. Olynick
(74) *Attorney, Agent, or Firm* — Norton Rose Fulbright Canada LLP

(57) ABSTRACT

A diffuser pipe includes a tubular body defining a pipe center axis extending therethrough. The tubular body includes a first portion extending in a first direction from an inlet of the tubular body, a second portion extending in a second direction transverse to the first direction and terminating at a pipe outlet, and a bend portion fluidly linking the first portion and the second portion. A stiffening rib extends outwardly from an outer surface of the first portion of the tubular body.

19 Claims, 2 Drawing Sheets

DIFFUSER PIPE WITH STIFFENING RIB

TECHNICAL FIELD

The disclosure relates generally to centrifugal compressors, and more particularly to diffuser pipes for centrifugal compressors.

BACKGROUND

Diffuser pipes are provided in certain gas turbine engines for diffusing a flow of high speed air received from an impeller of a centrifugal compressor and directing the flow to a downstream component, such as an annular chamber containing the combustor or another compression stage. Diffuser pipes are typically circumferentially arranged at a periphery of the impeller, and are designed to transform kinetic energy of the flow into pressure energy. Vibrations and other loads to which the diffuser pipes are exposed after prolonged operation can contribute, in some cases, to undesirable results (e.g. cracks in the diffuser pipes).

SUMMARY

There is disclosed a diffuser pipe for a centrifugal compressor of a gas turbine engine, the diffuser pipe comprising: a tubular body defining a pipe center axis extending therethrough, the tubular body including a first portion extending in a first direction from an inlet of the tubular body, a second portion extending in a second direction transverse to the first direction and terminating at a pipe outlet, and a bend portion fluidly linking the first portion and the second portion, a stiffening rib extending outwardly from an outer surface of the first portion of the tubular body There is disclosed a method of reinforcing a diffuser pipe of a centrifugal compressor of a gas turbine engine, the method comprising: providing a stiffening rib extending outwardly from an outer surface of an upstream portion of the diffuser pipe adjacent to an inlet of the diffuser pipe There is disclosed a compressor diffuser for a gas turbine engine having a center axis, the compressor diffuser comprising: a plurality of diffuser pipes having a tubular body defining a pipe center axis extending therethrough, the tubular body including a first portion extending in a generally radial direction relative to the center axis and from an inlet of the tubular body, a second portion extending in a generally axial direction relative to the center axis and terminating at a pipe outlet, and a bend portion fluidly linking the first portion and the second portion, a stiffening rib extending outwardly from an outer surface of the first portion of the tubular body

BRIEF DESCRIPTION OF THE DRAWINGS

Reference is now made to the accompanying figures in which.

DETAILED DESCRIPTION

Figure 1:
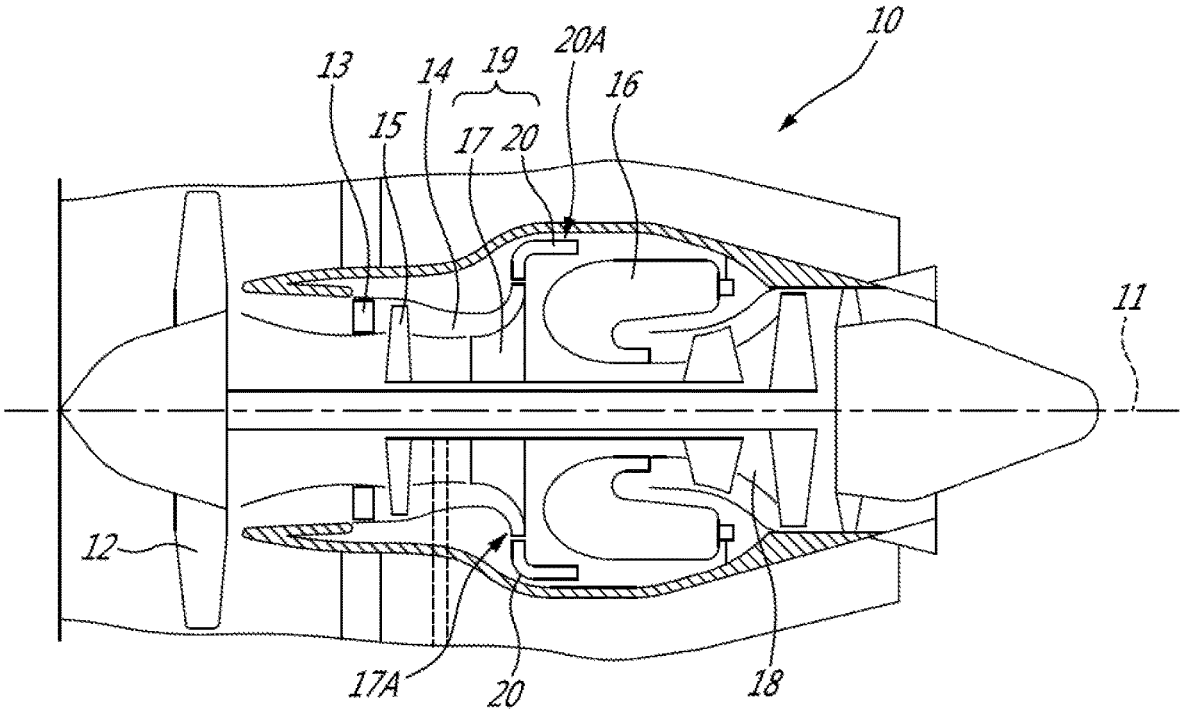
FIG. 1 is a schematic cross-sectional view of a gas turbine engine.

FIG. 1 illustrates a gas turbine engine 10 of a type preferably provided for use in subsonic flight, generally comprising in serial flow communication along an engine center axis 11 a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The compressor section 14 may include a plurality of stators 13 and rotors 15 (only one stator 13 and rotor 15 being shown in FIG. 1), and it may include a centrifugal compressor 19.

The centrifugal compressor 19 of the compressor section 14 includes an impeller 17 and a plurality of diffuser pipes 20, which are located downstream of the impeller 17 and circumferentially disposed about a periphery of a radial outlet 17A of the impeller 17. The diffuser pipes 20 convert high kinetic energy at the impeller 17 exit to static pressure by slowing down fluid flow exiting the impeller. The diffuser pipes 20 may also redirect the air flow from a radial orientation to an axial orientation (i.e. aligned with the engine axis 11). The diffuser pipes 20 are thus part of a compressor diffuser 20A. In most cases, the Mach number of the flow entering the diffuser pipe 20 may be at or near sonic, while the Mach number exiting the diffuser pipe 20 may be less than 0.25 to enable stable air/fuel mixing, and light/relight in the combustor 16.

Figure 2:
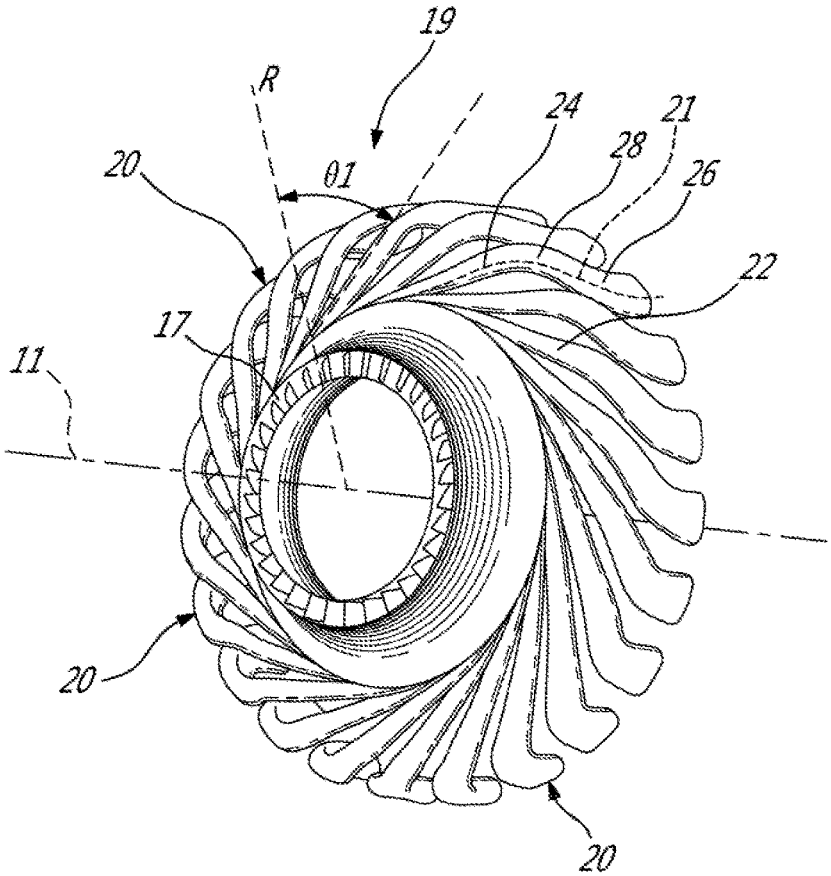
FIG. 2 is a perspective view of a centrifugal compressor of the gas turbine of FIG. 1, the centrifugal compressor including an impeller and diffuser pipes.

FIG. 2 shows the impeller 17 and the plurality of diffuser pipes 20, also referred to as "fishtail diffuser pipes", of the centrifugal compressor 19. Each of the diffuser pipes 20 includes a diverging (in a downstream direction) tubular body 22, formed, in one embodiment, of sheet metal. The enclosed tubular body 22 defines a flow passage 29 (see FIG. 3A) extending through the diffuser pipe 20 through which the compressed fluid flow is conveyed. The tubular body 22 includes a first portion 24 extending generally tangentially from the periphery and radial outlet 17A of the impeller 17. An open end is provided at an upstream end of the tubular body 22 and forms an inlet 23 (see FIG. 3A) of the diffuser pipe 20. The first portion 24 is inclined at an angle 81 relative to a radial axis R extending from the engine axis 11. The angle 81 may be at least partially tangential, or even substantially tangentially, and may further correspond to a direction of fluid flow at the exit of the blades of the impeller 17, such as to facilitate transition of the flow from the impeller 17 to the diffuser pipes 20. The first portion 24 of the tubular body 22 can alternatively extend more substantially along the radial axis R.

The tubular body 22 of the diffuser pipes 20 also includes a second portion 26, which is disposed generally axially relative to the engine axis 11 and is connected to the first portion 24 by an out-of-plane curved or bend portion 28. An open end at the downstream end of the second portion 26 forms a pipe outlet 25 (see FIG. 3A) of the diffuser pipe 20. Preferably, but not necessarily, the first portion 24 and the second portion 26 of the diffuser pipes 20 are integrally formed together and extend substantially uninterrupted between each other, via the curved, bend portion 28.

The large radial velocity component of the flow exiting the impeller 17, and therefore entering the first portion 24 of each of the diffuser pipes 20, may be removed by shaping the diffuser pipe 20 with the bend portion 28, such that the flow is redirected axially through the second portion 26 before exiting via the pipe outlet 25 to the combustor 16. It will thus be appreciated that the flow exiting the impeller 17 enters the inlet 23 and the upstream first portion 24 and flows along a generally radial first direction. At the outlet of the first portion 24, the flow enters the bend portion 28 which functions to turn the flow from a substantially radial direction to a substantially axial direction. The bend portion 28 may form a 90 degree bend. At the outlet of the bend portion 28, the flow enters the downstream second portion 26 and flows along a substantially axial second direction different from the generally radial first direction. By "generally radial", it is understood that the flow may have axial, radial, and/or circumferential velocity components, but that the axial and circumferential velocity components are much smaller in magnitude than the radial velocity component. Similarly, by "generally axial", it is understood that the flow may have axial, radial, and/or circumferential velocity components, but that the radial and circumferential velocity components are much smaller in magnitude than the axial velocity component.

Figure 3A:
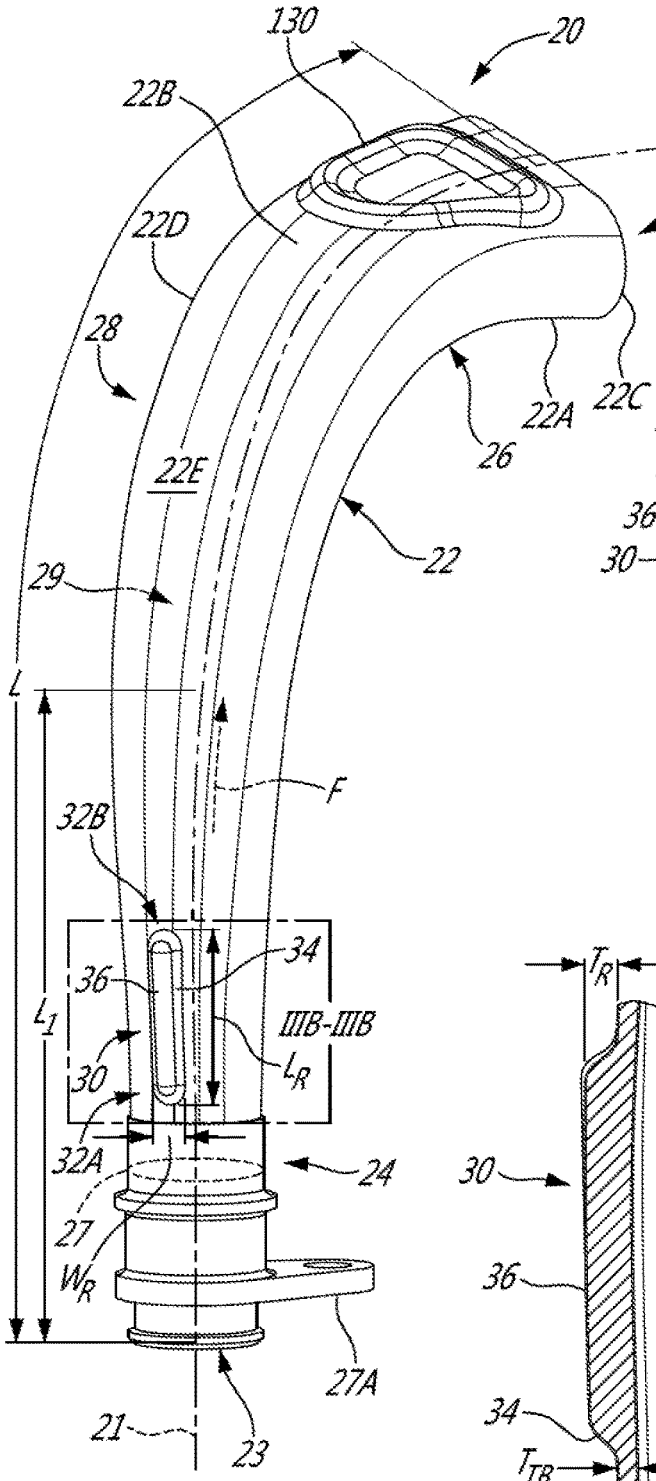
FIG. 3A is a perspective view of one of the diffuser pipes of FIG. 2.

Referring now to FIG. 3A, the tubular body 22 of each diffuser pipe 20 has a radially inner wall 22A and a radially outer wall 22B. The tubular body 22 also has a first side wall 22C spaced circumferentially apart across the flow passage 29 from a second side wall 22D. The radially inner and outer walls 22A,22B and the first and second side walls 22C,22D meet and are connected to form the enclosed flow passage 29 extending through the tubular body 22. The radially inner and outer walls 22A,22B and the first and second side walls 22C,22D meet and are connected to form a peripheral edge of the tubular body 22 which circumscribes the pipe outlet 25. The radially inner wall 22A corresponds to the wall of the tubular body 22 that has the smallest turning radius at the bend portion 28, and the radially outer wall 22B corresponds to the wall of the tubular body 22 that has the largest turning radius at the bend portion 28. The tubular body 22 has an outer surface 22E forming an external exposed surface of the diffuser pipe 20, and an inner surface 22F (see FIG. 3C) along which fluid flow F moves through the diffuser pipe 20.

The tubular body 22 diverges in the direction of fluid flow F therethrough, in that the internal flow passage 29 defined within the tubular body 22 increases in cross-sectional area between the inlet 23 and the pipe outlet 25 of the tubular body 22. The increase in cross-sectional area of the flow passage 29 through each diffuser pipe 20 is gradual over the length of the diffuser pipe 20. The direction of fluid flow F is along a pipe center axis 21 of the tubular body 22. The pipe center axis 21 extends through each of the first, second, and bend portions 24,26,28 and has the same orientation as these portions. The pipe center axis 21 is thus curved. In the depicted embodiment, the pipe center axis 21 is equidistantly spaced from the radially inner and outer walls 22A, 22B of the tubular body 22, and from the first and second side walls 22C,22D, through the tubular body 22.

Still referring to FIG. 3A, the tubular body 22 has a length L defined from the inlet 23 to the pipe outlet 25. The length L of the tubular body 22 may be measured as desired. For example, in FIG. 3A, the length L is the length of the pipe center axis 21 from the inlet 23 to the pipe outlet 25. In an alternate embodiment, the length L is measured along one of the walls 22A,22B,22C,22D of the tubular body 22, from the inlet 23 to the pipe outlet 25. Reference is made herein to positions on the tubular body 22 along its length L. For example, a position on the tubular body 22 that is along a last 10% of the length L is anywhere in the segment of the tubular body 22 that is upstream of the pipe outlet 25 a distance equal to 10% of the length L. This same segment is also downstream of the inlet 23 a distance equal to 90% of the length L. Similarly, a position on the tubular body 22 that is along a first 90% of the length L is anywhere in the segment of the tubular body 22 that is downstream of the inlet 23 a distance equal to 90% of the length L. This same segment is also upstream of the pipe outlet 25 a distance equal to 10% of the length L.

The tubular body 22 is composed of many cross-sectional profiles which are arranged or stacked one against another along the length L of the tubular body 22. Each cross-sectional profile is a planar contour that lies in its own plane that is transverse or normal to the pipe center axis 21. The orientation of the cross-sectional profiles in the frame of reference of the diffuser pipe 20 may vary over the length L of the tubular body 22, depending on where the cross-sectional profiles are located along the pipe center axis 21. Each cross-sectional profile defines the shape, contour, or outline of the tubular body 22 at a specific location along the pipe center axis 21.

Referring to FIG. 3A, the diffuser pipe 20 defines and contains therein a throat 27 located at a point between the inlet 23 and the pipe outlet 25 of the diffuser pipe 20. More particularly, the throat 27 is located in the first portion 24 of the diffuser pipe 20, downstream of the inlet 23 and upstream of the curved portion or bend 28. The precise location of the throat 27 within the first portion 24 can be determined using the measured flow characteristics of the fluid flow F within the diffuser pipe 20, or can correspond to the part of the diffuser pipe 20 having the smallest cross-sectional area. In the former case, the throat 27 is referred to as the "aerodynamic throat", and in the latter case, the throat 27 is referred to as the "geometric throat". It is understood, however, that the aerodynamic throat may not necessarily occur at the same point as the geometric throat. For the geometric throat 27, sometimes referred to as the "neck" of the diffuser pipe 20, each diffuser pipe 20 expands in cross-sectional area along its length from the relatively small cross-sectional area of the geometric throat 27, thereby helping to diffuse the main gas flow as it is conveyed through the diffuser pipe 20.

The location of the aerodynamic throat 27 of the diffuser pipe 20 within the first portion 24 can vary depending on numerous factors such as the flow conditions of the fluid flow F in the diffuser pipe 20, the geometry of the diffuser pipe 20, and the flow conditions upstream and/or downstream of the diffuser pipe 20. For most applications, the location of the aerodynamic throat 27 within the first portion 24 can be suitably approximated for a given range of operating conditions of the compressor section 14 using fluid dynamic analysis, and is approximately the same as the location of the geometric throat 27 within the first portion 24.

Referring to FIG. 3A, the diffuser pipe has a flange 27A. The flange 27A is a bracket or mounting extending outwardly from the tubular body 22 in a radial direction from the pipe center axis 21. The flange 27A is used to fixedly mount the tubular body 22 to another structure, such as the casing housing the impeller 17. In FIG. 3A, the flange 27A is located in close proximity to the inlet 23 of the diffuser pipe 20. The flange 27A is along the first portion 24 of the tubular body 22, and is positioned adjacent to the inlet 23 and downstream therefrom.

Figure 3B:
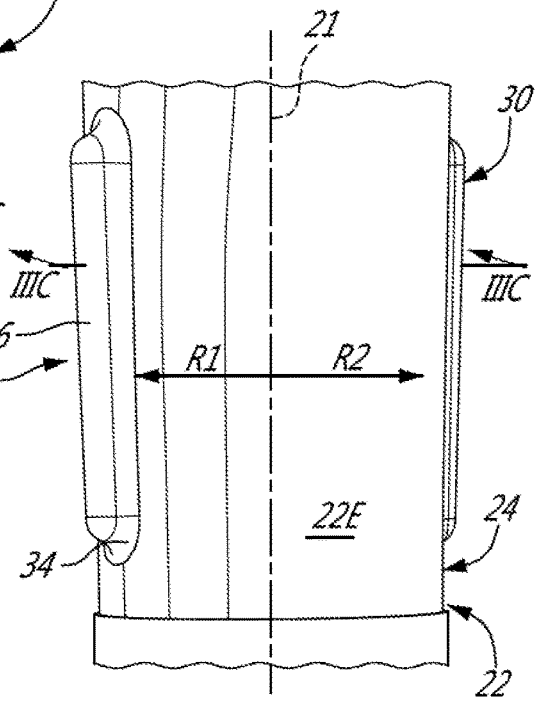
FIG. 3B is an enlarged perspective view of the portion IIIB-IIIB of the diffuser pipe of FIG. 3A.
Figure 3C:
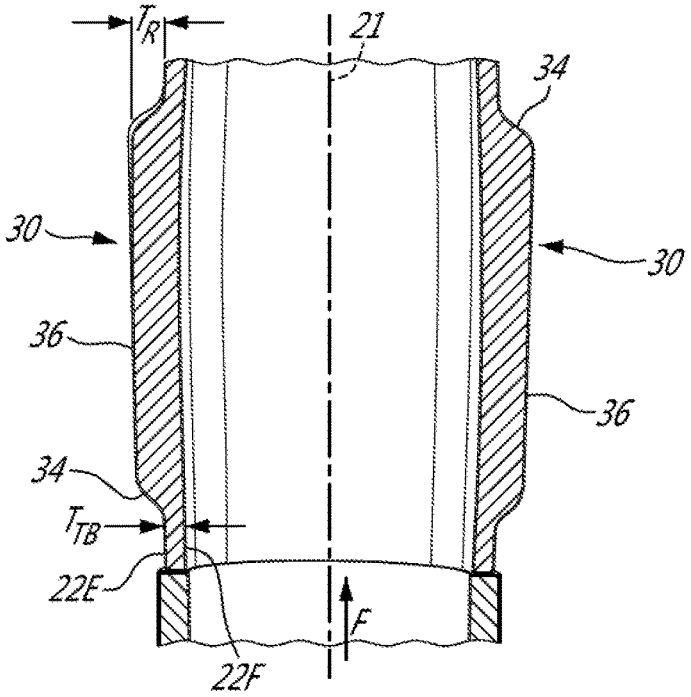
FIG. 3C is a cross-sectional view of the diffuser pipe of FIG. 3B, taken along the line IIIC-IIIC.

Referring to FIGS. 3A to 3C, the diffuser pipe 20 has one or more stiffening ribs 30. The stiffening rib 30 is a body which is attached to, or integral with, the tubular body 22, and used to stiffen or reinforce the base of the diffuser pipe 20. The stiffening rib 30 is a localised protrusion or bump in the depicted embodiment. The presence of the stiffening rib 30 on the diffuser pipe 20 may help to reduce vibratory stresses for certain dynamic modes of vibration of the diffuser pipe 20 during the operation of the engine 10. The location, length, and shape of the stiffening rib 30 may vary, and some possible configurations are described in greater detail below.

The stiffening rib 30 extends outwardly from the outer surface 22E of the tubular body 22, and is located in the first portion 24 of the tubular body 22. In the depicted embodiment, the stiffening rib 30 projects outwardly from the outer surface 22E along a direction being radial to the pipe center axis 21. The stiffening rib 30 is free standing. The stiffening rib 30 is connected only to the tubular body 22. The stiffening rib 30 is connected only to the outer surface 22E of the tubular body 22.

In FIGS. 3A to 3C, the stiffening rib 30 is positioned upstream of the bend portion 28. The stiffening rib 30 is positioned between the inlet 23 of the diffuser pipe 20 and the bend portion 28. The stiffening rib 30 is positioned between the throat 27 of the diffuser pipe 20 and the bend portion 28. The stiffening rib 30 is positioned only in the first portion 24 of the tubular body 22. The positioning of the stiffening rib 30 in the upstream first portion 24 of the tubular body 22 may improve the dynamic response of the diffuser pipe 20 to the vibratory stresses to which the diffuser pipe 20 may be exposed during operation of the gas turbine engine 10. The stiffening rib 30 adds mass and stiffness around the root of the diffuser pipe 20, which may help to increase the dynamic response modes at certain frequencies. The stiffening rib 30 may be made from any suitable material. In an embodiment, the stiffening rib 30 is made from sheet metal of the same type or gauge as the sheet metal used for the tubular body 22.

In FIG. 3A, the stiffening rib 30 is an elongated body. The stiffening rib 30 has a length defined along the pipe center axis 21 that is longer than its width defined along the circumference of the outer surface 22E of the tubular body 22. The stiffening rib 30 has an upstream end 32A and a downstream end 32B. The upstream and downstream ends 32A,32B, are defined relative to the direction of fluid flow F through the diffuser pipe 20. The downstream end 32B is closer than the upstream end 32A to the pipe outlet 25. The upstream end 32A is closer to the inlet 23 than the downstream end 32B. The upstream and downstream ends 32A, 32B are spaced apart from each other in a direction being parallel to the pipe center axis 21. The orientation of the stiffening rib 30 in FIG. 3A is parallel to the pipe center axis 21. The stiffening rib 30 is aligned with the pipe center axis 21. The stiffening rib 30 extends along a line that is angularly offset from the pipe center axis 21 by zero degrees. In an alternate embodiment, the stiffening rib 30 extends along a line that is angularly offset from the pipe center axis 21 by more or less than zero degrees, so as to be aligned with a direction along which the strain energy may be acting to help increase stiffness in that direction. In an alternate embodiment, the stiffening rib 30 extends circumferentially along the outer surface 22E of the tubular body 20. In an alternate embodiment, the stiffening rib 30 extends circumferentially along the outer surface 22E of the tubular body 20 and forms a "spiral" along the outer surface 22E. It will therefore be appreciated that the shape and orientation of the stiffening rib 30 is not limited to the shapes and orientations specifically described herein.

The upstream end 32A of the stiffening rib 30 is positioned adjacent to the inlet 23 of the tubular body 22. The upstream end 32A is in close proximity to the inlet 23, and downstream from the inlet 23. The upstream end 32A is in close proximity to the throat 27 or neck of the diffuser pipe 20, and downstream therefrom. The upstream end 32A is in close proximity to the flange 27A of the diffuser pipe 20, and downstream therefrom. In an embodiment, the stiffening rib 30 is located, or begins, at a position that is as close as possible, from a manufacturing perspective of the diffuser pipe 20, to the inlet 23 of the diffuser pipe 20. The diffuser pipe 20 is attached at its root or inlet 23 to the casing of the impeller 17 via the flange 27A, and is cantilevered therefrom. Therefore, the "overhang mass" of the bend and second portions 28,26 of the tubular body 22 impart a moment about the point of attachment of the diffuser pipe 20 to the casing of the impeller 17 and cause strain. Positioning the stiffening rib 30 in proximity to the inlet 23 places the stiffening rib 30 close to where the strain energy on the diffuser pipe 20 is highest, and thus helps to reinforce or stiffen the diffuser pipe 20 at that location.

Referring to FIG. 3A, the stiffening rib 30 has an axial extent or length $L_R$ that is defined along the pipe center axis 21. The axial extent or length $L_R$ of the stiffening rib 30 is defined between the upstream and downstream ends 32A, 32B. The axial extent or length $L_R$ of the stiffening rib 30 is less than a length $L_1$ of the tubular body 22 between the inlet 23 and an upstream end of the bend portion 28. The length $L_R$ of the stiffening rib 30 is less than the axial extent of the diffuser pipe 20 along the outer surface 22E between the inlet 23 and the bend portion 28. The stiffening rib 30 therefore does not extend into or past the bend portion 28 in FIG. 3A, and thus avoids adding additional weight that might contribute to the overhang mass and the strain caused thereby. The stiffening rib 30 has a width $W_R$ defined along a circumference of the tubular body 20. The width $W_R$ is less than the circumference. The minimum value width $W_R$ should be similar to the size of the zone where strain energy is concentrated to help dissipate the energy. The stiffening rib 30 therefore does not extend completely around the tubular body 22 in FIG. 3A. In an alternate embodiment, the stiffening rib 30 extends completely around the tubular body 22. In an embodiment, the stiffening rib 30 is formed from two pieces of sheet metal that are brazed at a similar location, so as to form a ring about the outer surface 22E of the tubular body 22 occupying about 75% of the circumference of the tubular body 22.

In the embodiment shown in FIG. 3A, the second portion 26 of the tubular body 22 includes an outlet protrusion 130. The outlet protrusion 130 extends outwardly from the outer surface 22E of the second portion 26. The outlet protrusion 130 is positioned downstream of the bend portion 28 and upstream of the pipe outlet 25. The outlet protrusion 130 is positioned adjacent to the pipe outlet 25. In FIG. 3A, the outlet protrusion 130 is formed by stamping the inner surface 22E of the tubular body 22, to protrude some of the material of the tubular body 22 outwardly from the outer surface 22E. A groove or depression is thus formed along the inner surface 22F of the tubular body 22 at the location of the outlet protrusion 130. The outlet protrusion 130 may thus be referred to as a "dimple", and it has a "D" shape in FIG. 3A. Reference is made to U.S. Pat. No. 9,874,223 in the name of the assignee Pratt & Whitney Canada Corp., the entire contents of which are incorporated by reference herein.

Referring to FIGS. 3B and 3C, the stiffening rib 30 does not obstruct or impede the fluid flow F within the tubular body 22. No portion of the stiffening rib 30 extends past the inner surface 22F of the tubular body 22 and into the fluid flow F. The stiffening rib 30 overlays a portion of the inner surface 22F along the first portion 24 of the tubular body 22. By overlay, it is understood that the stiffening rib 30 is positioned over or overlaps the portion of the inner surface 22F. The stiffening rib 30 occupies an area on the outer surface 22E that is the same as the area of the portion on the inner surface 22F that is overlapped. The overlapped portion of the inner surface 22F is continuous with a remainder of the inner surface 22F. The overlapped portion of the inner surface 22F is flush with a remainder of the inner surface 22F. Therefore, the localized protrusion formed by the stiffening rib 30 from the outer surface 22E does not alter or change the contour or shape of the inner surface 22F at the location of the stiffening rib 30.

As shown in FIG. 3B, the radial distance R1 of the portion of the inner surface 22F overlaid by the stiffening rib 30 from the pipe center axis 21 is the same as the radial distance R2 from the pipe center axis 21 to other parts of the inner surface 22F at the same axial position as the stiffening rib 30. In the diffuser pipe 20 shown in FIG. 3B, the stiffening rib 30 is a bump on the outer surface 22E when seen from the outside of the diffuser pipe 20, and would be flat when seen from the inside of the diffuser pipe 20. The continuous inner surface 22F under the stiffening rib 30 is in contrast to some conventional pipes, which stamp or depress parts of the inner surface of the pipe at an outlet thereof to form a protrusion. This stamping/depressing may impact the fluid flow in the area of the protrusion.

Referring to FIGS. 3B and 3C, the two stiffening ribs 30 are identical. In an alternate embodiment, the stiffening ribs 30 have different extents, shapes, and/or thicknesses. The stiffening ribs 30 are disposed on circumferentially opposite sides of the outer surface at the same axial position along the pipe center axis 21. The stiffening ribs 30 are circumferentially spaced apart from each other. The outer surface 22E of the tubular body 22 between the stiffening ribs 30 at the same axial position is spaced a constant distance from the pipe center axis 21. Any suitable number of stiffening ribs 30 may be provided on the first portion 24 of the tubular body 22. In an embodiment, and as shown in FIGS. 3B and 3C, the total number of the stiffening ribs 30 is even. The stiffening ribs 30 may be arranged in opposite pairings, where each stiffening rib 30 in a pair of the stiffening ribs 30 is disposed on circumferentially opposite sides of the outer surface 22E at the same axial position.

Referring to FIG. 3C, the stiffening rib 30 has a thickness $T_R$ defined along a radial line from the pipe center axis 21. In an embodiment, the thickness $T_R$ is a maximum of about two and a half times the thickness $T_{TB}$ of the tubular body 22. In the depicted embodiment, the tubular body 22 is made from sheet metal and has a thickness $T_{TB}$ of about 35 thou. The thickness $T_R$ of the stiffening rib 30 may thus be between about 70 thou and 100 thou.

Referring to FIG. 3C, the stiffening rib 30 includes a projecting wall 34 intersecting the outer surface 22E of the tubular body 22 and extending outwardly therefrom. The stiffening rib 30 also includes an outer wall 36 intersecting the projecting wall 34 and spaced radially outwardly from the outer surface 22E. The radial distance between the outer wall 36 and the outer surface 22E defines the thickness $T_R$ of the stiffening rib 30. An intersection of the projecting wall 34 with the outer surface 22E is rounded to reduce stress concentrations. The intersection of the outer wall 36 with the projecting wall 34 is also rounded. The surface defined by the outer wall 36 is spaced radially outwardly from the outer surface 22E of the tubular body 22. The plane defined by the outer wall 36 is spaced radially outwardly from a plane defined by the outer surface 22E. The width $W_R$ of the stiffening rib 30 is measured between circumferentially spaced apart surfaces of the projecting wall 34. The axial length $L_R$ of the stiffening rib 30 is measured between surfaces of the projecting wall 34 that are spaced apart from each other in a direction parallel to the pipe center axis 21.

Referring to FIG. 3A, there is disclosed a method of reinforcing the diffuser pipe 20. The method includes providing the stiffening rib 30 extending outwardly from the outer surface 22E of an upstream portion of the diffuser pipe 20 adjacent to the inlet 23. The tubular body 22 and/or the stiffening rib 30 may be made with advanced manufacturing or conventional methods so that the stiffening rib 30 is integral with diffuser pipe 20. Using such advanced manufacturing techniques as additive manufacturing or metal injection molding (MIM), the external stiffening rib 30 may be printed or injected as part of the diffuser pipe 20. Using conventional methods such as stamping, forming, and/or welding/brazing, the stiffening rib 30 may be welded/brazed onto the flat sheet metal prior to stamping of the diffuser pipe 20. Alternatively, the sheet metal can be stamped, and the stiffening rib 30 may then be formed to follow the stamped diffuser pipe 20 and subsequently welded/brazed to the outer surface 22E of the diffuser pipe 20.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A compressor diffuser for a gas turbine engine having a center axis, the compressor diffuser comprising: a plurality of diffuser pipes, one or more diffuser pipes of the plurality of diffuser pipes having a tubular body defining a pipe center axis and a flow passage extending through the tubular body, the tubular body including a first portion extending in a generally radial direction relative to the center axis and from an inlet of the tubular body, a second portion extending in a generally axial direction relative to the center axis and terminating at a pipe outlet, and a bend portion fluidly linking the first portion and the second portion, a stiffening rib extending outwardly from an outer surface of the first portion of the tubular body at an axial position along the first portion, the stiffening rib disposed on the outer surface within the first portion of the tubular body, wherein the stiffening rib overlays a rib portion of an inner surface of the first portion of the tubular body at the axial position, the rib portion being uninterrupted and free of any flow-modifying projections into the flow passage.

2. The compressor diffuser of claim 1, wherein the stiffening rib has an upstream end and a downstream end, the upstream end of the stiffening rib positioned adjacent the inlet of the tubular body.

3. The compressor diffuser of claim 1, wherein the one or more diffuser pipes have a flange disposed adjacent the inlet and the stiffening rib has an upstream end and a downstream end, the upstream end of the stiffening rib positioned adjacent the flange.

4. The compressor diffuser of claim 1, wherein the stiffening rib overlays a portion of an inner surface of the first portion of the tubular body, the portion of the inner surface being continuous with a remainder of the inner surface.

5. The compressor diffuser of claim 1, wherein in a cross-sectional plane defined through the first portion normal to the pipe center axis, the stiffening rib overlays a rib portion of the inner surface of the first portion of the tubular body, the rib portion of the inner surface spaced a distance from the pipe center axis, a non-rib portion of the inner surface in the cross-sectional plane is spaced circumferentially from the rib portion relative to the pipe center axis, the non-rib portion of the inner surface in the cross-sectional plane is spaced the same distance from the pipe center axis as the rib portion.

6. The compressor diffuser of claim 1, wherein the stiffening rib has an orientation parallel to the pipe center axis.

7. The compressor diffuser of claim 1, wherein the stiffening rib is a first stiffening rib, the one or more diffuser pipes having a second stiffening rib extending outwardly from the outer surface of the first portion of the tubular body, the first and second stiffening ribs disposed on circumferentially opposite sides of the outer surface at a same axial position along the pipe center axis.

8. The compressor diffuser of claim 1, wherein the stiffening rib is a first stiffening rib, the one or more diffuser pipes having additional stiffening ribs extending outwardly from the outer surface of the first portion of the tubular body, a total number of the stiffening ribs being even, pairs of the stiffening ribs disposed on circumferentially opposite sides of the outer surface at a same axial position along the pipe center axis.

9. The compressor diffuser of claim 1, wherein the stiffening rib has an axial extent defined along the pipe center axis, the axial extent being less than a length of the tubular body between the inlet and an upstream end of the bend portion.

10. The compressor diffuser of claim 1, wherein the stiffening rib has a thickness defined along a radial line from the pipe center axis, the thickness being a maximum of two and a half times a thickness of the tubular body.

11. The compressor diffuser of claim 1, wherein the stiffening rib has a width defined along a circumference of the tubular body, the width being less than the circumference of the tubular body.

12. The compressor diffuser of claim 1, wherein the stiffening rib includes a projecting wall intersecting the outer surface of the tubular body and extending outwardly therefrom, and an outer wall intersecting the projecting wall and spaced radially outwardly from the outer surface, an intersection of the projecting wall with the outer surface being rounded.

13. A diffuser pipe for a centrifugal compressor of a gas turbine engine, the diffuser pipe comprising: a tubular body defining a pipe center axis and a flow passage extending through the tubular body, the tubular body including a first portion extending in a first direction from an inlet of the tubular body, a second portion extending in a second direction transverse to the first direction and terminating at a pipe outlet, and a bend portion fluidly linking the first portion and the second portion, a stiffening rib extending outwardly from an outer surface of the first portion of the tubular body, only the first portion of the tubular body having the stiffening rib wherein in a cross-sectional plane defined through the first portion normal to the pipe center axis, the stiffening rib overlays a rib portion of an inner surface of the rib portion of the tubular body, the rib portion of the inner surface spaced a distance from the pipe center axis, a non-rib portion of the inner surface in the cross-sectional plane is spaced circumferentially from the rib portion relative to the pipe center axis, the rib-portion and the non-rib portion forming the inner surface of the flow passage, the non-rib portion of the inner surface in the cross-sectional plane is spaced the same distance from the pipe center axis as the rib portion.

14. The diffuser pipe of claim 13, wherein the stiffening rib has an upstream end and a downstream end, the upstream end of the stiffening rib positioned adjacent the inlet of the tubular body.

15. The diffuser pipe of claim 13, wherein the stiffening rib overlays a portion of an inner surface of the first portion of the tubular body, the portion of the inner surface being continuous with a remainder of the inner surface.

16. The diffuser pipe of claim 13, wherein the stiffening rib has an orientation parallel to the pipe center axis.

17. The diffuser pipe of claim 13, wherein the stiffening rib is a first stiffening rib, the diffuser pipe having a second stiffening rib extending outwardly from the outer surface of the first portion of the tubular body, the first and second stiffening ribs disposed on circumferentially opposite sides of the outer surface at a same axial position.

18. The diffuser pipe of claim 13, wherein the stiffening rib has a thickness defined along a radial line from the pipe center axis, the thickness being a maximum of two and a half times a thickness of the tubular body.

19. A method of reinforcing a diffuser pipe of a centrifugal compressor of a gas turbine engine, the diffuser pipe comprising: a tubular body defining a pipe center axis and a flow passage extending through the tubular body, the tubular body including a first portion extending in a first direction from an inlet of the tubular body, a second portion extending in a second direction transverse to the first direction and terminating at a pipe outlet, and a bend portion fluidly linking the first portion and the second portion, the method comprising: providing a stiffening rib extending outwardly from an outer surface of an upstream portion of the diffuser pipe at an axial position adjacent to an inlet of the diffuser pipe, only the first portion of the tubular body having the stiffening rib, the stiffening rib disposed on the outer surface of the upstream portion of the diffuser pipe, wherein the stiffening rib overlays a rib portion of an inner surface of the upstream portion of the diffuser pipe at the axial position, the rib portion being uninterrupted and free of any flow-modifying projections into the flow passage.

* * * * *